US008042797B2

(12) United States Patent
Fujimori et al.

(10) Patent No.: US 8,042,797 B2
(45) Date of Patent: Oct. 25, 2011

(54) SHEET FEEDING APPARATUS AND IMAGE FORMING APPARATUS

(75) Inventors: Takashi Fujimori, Moriya (JP); Keita Takahashi, Abiko (JP)

(73) Assignee: Canon Kabushiki Kaisha (JP)

( * ) Notice: Subject to any disclaimer, the term of this patent is extended or adjusted under 35 U.S.C. 154(b) by 178 days.

(21) Appl. No.: 12/481,717

(22) Filed: Jun. 10, 2009

(65) Prior Publication Data

US 2009/0302522 A1 Dec. 10, 2009

(30) Foreign Application Priority Data

Jun. 10, 2008 (JP) ..... 2008-151280

(51) Int. Cl.
*B65H 3/14* (2006.01)

(52) U.S. Cl. ..... 271/97

(58) Field of Classification Search ..... 271/97
See application file for complete search history.

(56) References Cited

U.S. PATENT DOCUMENTS

| | | | | |
|---|---|---|---|---|
| 7,016,641 | B2 * | 3/2006 | Matsumoto et al. | 399/390 |
| 7,140,605 | B2 * | 11/2006 | Suga et al. | 271/97 |
| 7,140,606 | B2 * | 11/2006 | Suga et al. | 271/97 |
| 7,249,759 | B2 * | 7/2007 | Komatsu et al. | 271/97 |
| 7,419,152 | B2 * | 9/2008 | Adachi | 271/97 |
| 7,445,205 | B2 * | 11/2008 | Soures et al. | 271/97 |
| 2007/0096387 | A1 * | 5/2007 | Sciurba et al. | 271/152 |

FOREIGN PATENT DOCUMENTS

| | | | |
|---|---|---|---|
| JP | 6-032473 | A | 2/1994 |
| JP | 2001-048366 | A | 2/2001 |

* cited by examiner

*Primary Examiner* — Kaitlin Joerger
*Assistant Examiner* — Ernesto Suarez
(74) *Attorney, Agent, or Firm* — Rossi, Kimms & McDowell LLP

(57) ABSTRACT

A sheet feeding apparatus 80 includes a lifter plate 23 that is disposed in a sheet storage case 4 and stacks a sheet 7*a*, an air heater 14 and a fan 11 that blow heated air to the sheet 7*a* stacked on the lifter plate 23, and a control device 16 that changes a control condition of the heated air blown by the air heater 14 and the fan 11 based on a storage period of time of the sheet 7*a* on the lifter plate 23.

14 Claims, 11 Drawing Sheets

| TYPE OF SHEET | ENVIRONMENTAL COMPARTMENT | PASSAGE TIME AFTER SUPPLY | | |
|---|---|---|---|---|
| | | - 2 HOUR | 2- 24 HOUR | 24 HOUR - |
| COAT SHEET | E1 ENVIRONMENT | 0℃ | −10℃ | −15℃ |
| | E2 ENVIRONMENT | 0℃ | −15℃ | −30℃ |
| NON-COAT SHEET | E1 ENVIRONMENT | 0℃ | 0℃ | 0℃ |
| | E2 ENVIRONMENT | 0℃ | 0℃ | 0℃ |

CASE OF COAT SHEET

CASE OF NON-COAT SHEET

*FIG. 7*

| TYPE OF SHEET | ENVIRONMENTAL COMPARTMENT | PASSAGE TIME AFTER SUPPLY | | |
|---|---|---|---|---|
| | | - 2 HOUR | 2- 24 HOUR | 24 HOUR - |
| COAT SHEET | E1 ENVIRONMENT | 0°C | −10°C | −15°C |
| | E2 ENVIRONMENT | 0°C | −15°C | −30°C |
| NON-COAT SHEET | E1 ENVIRONMENT | 0°C | 0°C | 0°C |
| | E2 ENVIRONMENT | 0°C | 0°C | 0°C |

| 807 | 808 | 809 |
|---|---|---|
| ID = 1 | ID = 2 | ID = 3 |
| 150 | 470 | 830 |
| 0 | 150 | 470 |
| 07.07.10.16:40 | 07.07.10.21:12 | 07.07.10.23:37 |
| 850 | 530 | 170 |
| 0 | 1 | 2 |

SHEET FEEDING APPARATUS AND IMAGE FORMING APPARATUS

BACKGROUND OF THE INVENTION

1. Field of the Invention

The present invention relates to a sheet feeding apparatus that includes a sheet stacking portion, which stacks sheets disposed in a sheet feeding apparatus body, and a heated air blowing portion, which blows heated air to the sheets stacked to the sheet stacking portion.

2. Description of the Related Art

In an image forming apparatus, such as a copying machine or a printer, continuously feedable sheets are generally limited to high quality paper or plain paper designated by a copying machine maker. In these sheets, since smoothness of a surface is low and air permeability is high (air can easily pass through the sheets), the air easily flows between the sheets. Accordingly, when each sheet is extracted from the stacked sheets, absorption between the sheets is rarely generated. As a result, overlapping sheet feeding is rarely generated.

Meanwhile, in recent years, with diversification of a recording medium, an image may be formed on thick paper, an OHP sheet, and tracing paper. Further, in order to give a white degree or luster in accordance with a market request for coloring, even in sheets having a smooth surface, such as coat paper and art paper where a surface of a sheet is subjected to coating processing, an image formation request has been increased. In addition, in the OHP sheet, the tracing paper, the art paper, and the coat paper, since smoothness is high and air permeability is low (air rarely passes through them), the air is not easily flown between the sheets. Accordingly, when the sheets are stacked in a high-humidity environment in particular, the sheets can be easily absorbed there between. In a friction separation system that is generally used in a copying machine or a printer according to the related art, separation is not sufficiently made. As a result, overlapping sheet feeding or erroneous feeding is frequently generated.

In regards to the sheets that have the high smoothness and the low air permeability, techniques for suppressing absorption between the sheets and reducing overlapping sheet feeding or erroneous feeding are disclosed in Japanese Patent Application Laid-Open Nos. 6-32473 and 2001-048366.

Specifically, Japanese Patent Application Laid-Open No. 6-32473 discloses a sheet feeding apparatus including an air exhaust portion that blows air heated by a dehumidifying heater provided at the lower side of a housing frame to a top surface or a side surface of a sheet stacked on a stack tray. According to this apparatus, it is possible to resolve a problem of absorption between the sheets by blowing the heated air to the sheets and removing humidity.

Japanese Patent Application Laid-Open No. 2001-048366 discloses a sheet feeding apparatus including an air blowing portion that blows air heated by an air heating portion to sheets stored in a sheet storage portion. According to this apparatus, it is possible to resolve a problem of absorption between the sheets by controlling the air heating portion and blowing air having proper humidity.

Meanwhile, according to the techniques that are related to sheet feeding disclosed in Japanese Patent Application Laid-Open Nos. 6-32473 and 2001-048366, if a sheet bundle is additionally stacked in a state where the sheets are stored in the sheet feeding apparatus, the sheets that are stored in the sheet feeding apparatus are located below the added sheet bundle. The sheets that are located at the bottom portion continuously are stored in the sheet feeding apparatus until there is no sheet that is stored in the sheet feeding apparatus. As such, if a long period of time passes in a state where the sheets are not used, moisture that is contained in the sheets may be continuously evaporated by the heated air blown to the sheets. In addition, if proper moisture is not contained in the sheets, warping is generated in the sheets. As a result, a sheet conveyance defect may be easily generated, or a surface property of the sheet or an electrostatic resistance value varies to cause a defective image to be easily formed. Accordingly, between the sheets that are stored in the sheet feeding apparatus for a long period of time and sheets that are newly stacked, image qualities may be different from each other, even though the same printed material is formed. In order to avoid this problem, a method is considered in which the amount of moisture contained in sheets having various surface properties is measured at the time of feeding the sheets and an image formation condition is changed. However, it is difficult to carry out the method, because the amount of contained moisture should be instantaneously measured at the time of feeding the sheets. Further, a method is also considered in which provided is a measuring apparatus that measures the amount of moisture of the sheets stored in the sheet feeding apparatus. However, if the measuring apparatus is provided, this causes enormous costs.

Accordingly, the present invention provides a sheet feeding apparatus that can properly maintain the amount of moisture contained in a sheet even though a storing period of time of the sheet is increased, prevent a sheet conveyance defect and an image formation defect on the sheet from being generated due to a decrease in the amount of moisture contained in the sheet, and stably output a high-quality printed material.

SUMMARY OF THE INVENTION

A sheet feeding apparatus according to an embodiment of the present invention includes a sheet stacking portion that stores sheets; a heated air blowing portion that blows heated air to the sheets stacked on the sheet stacking portion; and an air condition changing portion that changes a control condition of the heated air blown by the heated air blowing portion based on a storage period of time where each of the sheets is stored on the sheet stacking portion.

Further features of the present invention will become apparent from the following description of exemplary embodiments with reference to the attached drawings.

BRIEF DESCRIPTION OF THE DRAWINGS

FIG. 7 is a diagram illustrating a temperature correction table for heater control.

DESCRIPTION OF THE EMBODIMENTS

Figure 1:
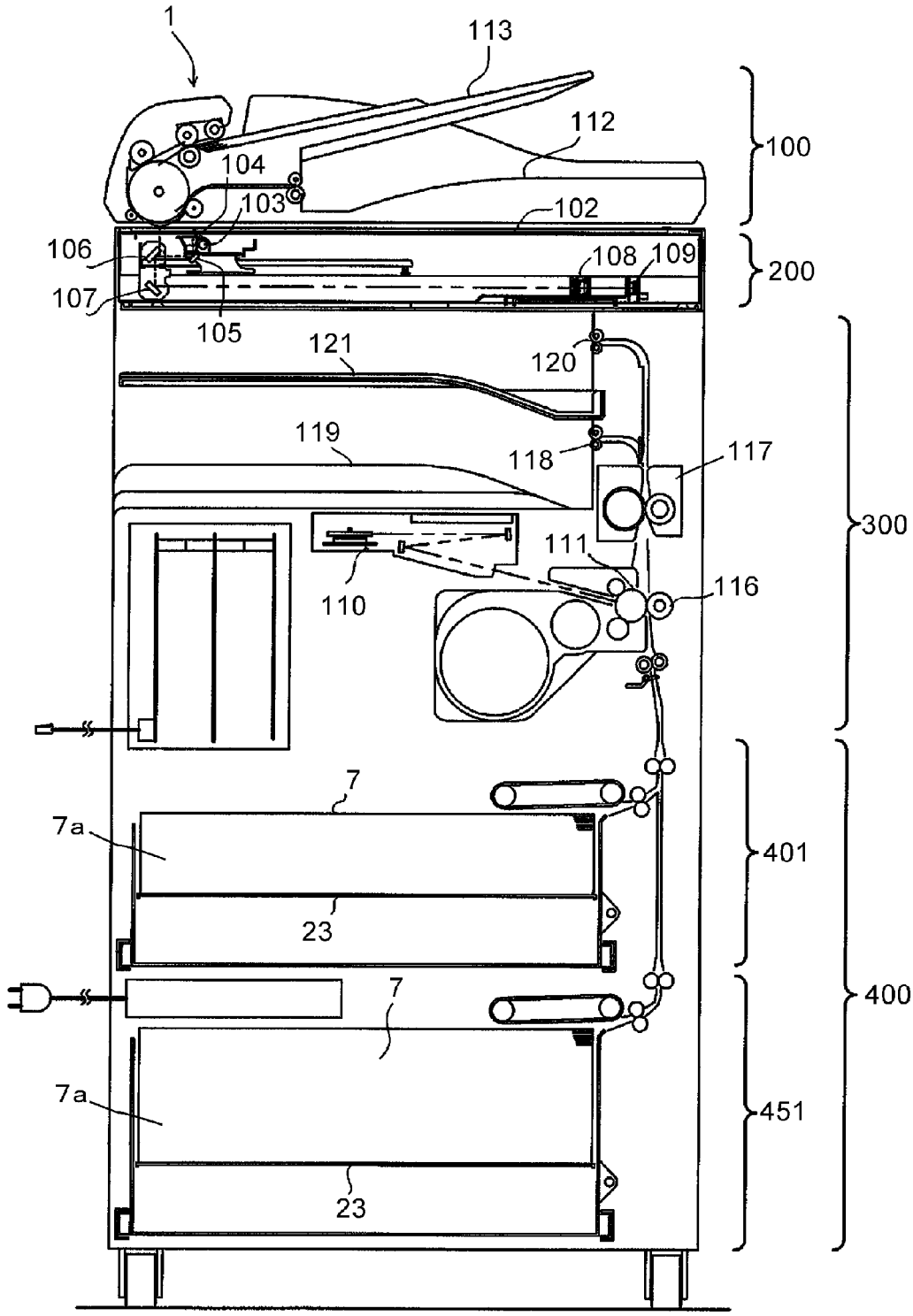
FIG. 1 is a cross-sectional view illustrating the main configuration of a copying machine according to an embodiment of the present invention.

FIG. 1 is a cross-sectional view illustrating the main configuration of a copying machine 1 according to an embodiment of the present invention. As illustrated in FIG. 1, the copying machine 1 that serves as an image forming apparatus includes an image reader 200 that reads out an original image, a printer 300, and a feeding portion 400. The feeding portion 400 includes sheet storage cases 401 and 451 that include a common feeding mechanism. Each of the sheet storage cases 401 and 451 stores a bundle of sheets 7*a*, that is, a sheet bundle 7. The sheet storage case 401 can store the sheet bundle 7 that includes 1000 sheets. The sheet storage case 451 can store the sheet bundle 7 that includes 1500 sheets.

The sheet storage cases 401 and 451 may include an air heater or a fan serving as a "heated air blowing portion" that adjusts the temperature of air blown to the sheets 7*a* based on a condition of the internal temperature or humidity of the sheet storage cases 401 and 451. Further, the sheet storage cases 401 and 451 may include a dehumidifying heater that constantly maintains a condition of the temperature or humidity of the internal air of the sheet storage cases 401 and 451.

The image reader 200 is mounted with an original feeding apparatus 100. The original feeding apparatus 100 feeds each of the original sheets as the sheets upwardly set to an original tray 113 in a leftward direction sequentially from a head sheet. The original feeding apparatus 100 conveys the original sheet from a left side on a platen glass 102 via a moving original image reading position to a right side along a curved path, and discharges the original sheet to an external discharge tray 112. When the original sheet passes through the moving original image reading position on the platen glass 102 from the left side to the right side, the original image is read out by a scanner unit 104 that is held at a position corresponding to the moving original image reading position. The reading method is generally called a moving original reading method. Specifically, when the original sheet passes through the moving original image reading position, a lamp 103 of the scanner unit 104 irradiates light onto a reading surface of the original sheet, and the light reflected from the original sheet is guided to a lens 108 through mirrors 105, 106, and 107. The light that has passed through the lens 108 forms an image on an imaging surface of an image sensor 109.

As such, if the original sheet is conveyed such that the original sheet passes through the moving original image reading position from the left side to the right side, original reading scanning where a direction orthogonal to a conveying direction of the original sheet is used as a main scanning direction and the conveying direction is used as a sub-scanning direction is performed. That is, when the original sheet passes though the moving original image reading position, the original sheet is conveyed in the sub-scanning direction while the original image is read out by the image sensor 109 for each line in a main scanning direction, such that the entire original image is read out. In addition, the optically read image is converted into image data by the image sensor 109 and is then output. The image data that is output from the image sensor 109 is subjected to a predetermined process in an image signal controlling portion (not illustrated) and is then input to an exposure controlling portion 110 of the printer 300 as a video signal.

Further, the original feeding apparatus 100 conveys the original base to the platen glass 102 and stops the original base at a predetermined position. In this state, the scanner unit 104 scans the original base from a left side to a right side. As a result, the original sheet can be read out. This reading method is called a so-called fixed original reading method. When the original base is read out without using the original feeding apparatus 100, first, a user lifts the original feeding apparatus 100 and places the original sheet on the platen glass 102. In addition, the original sheet is read out by allowing the scanner unit 104 to scan the original sheet from a left side to a right side. That is, when the original sheet is read out without using the original feeding apparatus 100, fixed original reading is performed.

Based on the input video signal, the exposure controlling portion 110 of the printer 300 modulates a laser beam and outputs the modulated laser beam. The laser beam is irradiated onto a photosensitive drum 111 while being scanned by a polygon mirror. An electrostatic latent image according to the scanned laser beam is formed on the photosensitive drum 111. Here, as described in detail below, when the fixed original reading is performed, the exposure controlling portion 110 outputs a laser beam such that a correct image (image that is not a mirror image) is formed.

The electrostatic latent image on the photosensitive drum 111 is converted into a visible image as a developer image by a developer that is supplied from a development device (not illustrated). Further, at timing that is synchronized with a point of time when the laser beam starts to be irradiated, the sheet is fed from each of the sheet storage cases 401 and 451 or a duplex conveying path. This sheet is conveyed between the photosensitive drum 111 and a transfer portion 116. The developer image that is formed on the photosensitive drum 111 is transferred to the sheet that is fed by the transfer portion 116.

The sheet where the developer image is transferred is conveyed to a fixing portion 117, and the fixing portion 117 thermally pressurizes the sheet 7*a* and fixes the developer image on the sheet 7*a*. By switching a flapper (not illustrated), the sheet 7*a* that has passed through the fixing portion 117 is discharged to a first discharge tray 119 through a first discharge roller 118 or a second discharge tray 121 through a second discharge roller 120.

Figure 2:
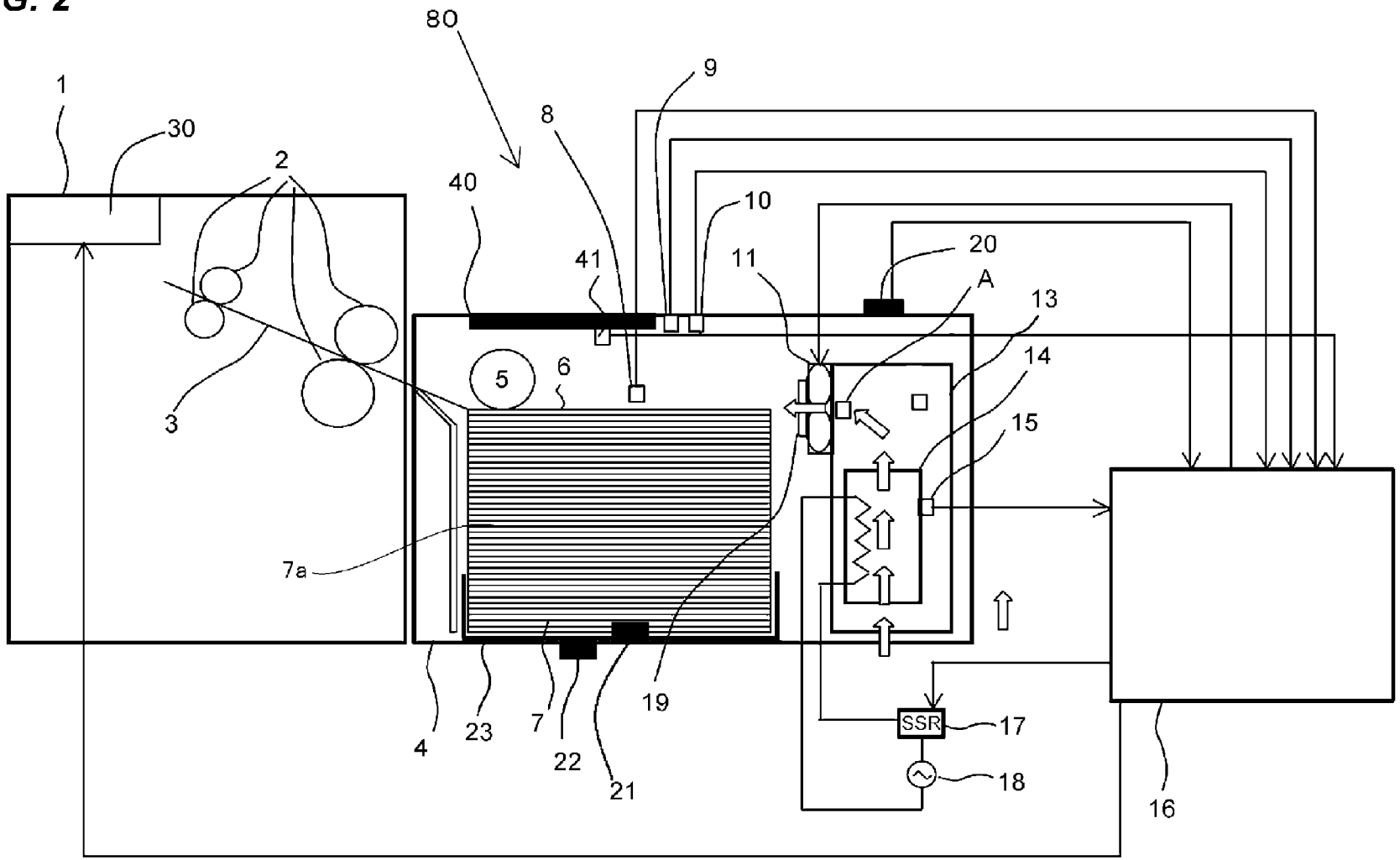
FIG. 2 is a schematic diagram illustrating the configuration of a sheet feeding apparatus that is mounted in a copying machine.

FIG. 2 is a schematic diagram illustrating the configuration of a sheet feeding apparatus 80 that is mounted in a copying machine 1. The sheet feeding apparatus 80 may be provided separately from the copying machine 1 as illustrated in FIG. 2 or provided in the copying machine 1. As described above, the sheet feeding apparatus 80 includes an air loosening mechanism, an air heater, and a dehumidifying heater (not illustrated), which are installed in a sheet storage case 4 that is a "sheet feeding apparatus body".

As illustrated in FIG. 2, the copying machine 1 is supplied with the sheet 7*a* from the sheet storage case 4 through a conveying roller 2 and a conveyance path 3, and forms an image on the sheet 7*a*. A pick-up roller 5 starts to rotate at the same time as when sheet feeding starts, and the uppermost sheet 6 that is placed at the highest position is transmitted to the conveying roller 2 and the conveyance path 3. In this case, the sheet 7*a* may be fed using the pick-up roller 5, but may be fed by air feeding through an air sucking belt (not illustrated).

A sheet detecting sensor 8 serving as a "sheet surface position detecting portion" that is a "sheet bundle position detecting portion" detects "sheet information", for example, the thickness, density, and size of the sheet 7*a*, and transmits the sheet information to a "control portion" serving as an "air condition changing portion", that is, a control device 16. The control device 16 functions as a "warm air control condition changing portion" that changes a control condition of warm air. Further, the "sheet information" may be input from an operation screen 30 by the user. Further, the sheet detecting sensor 8 detects that the uppermost sheet 6 of the sheet bundle 7 is moved up to the highest position of an inner portion of the sheet storage case 4.

A temperature detecting sensor 9 that is a "temperature detecting portion" detects the internal temperature of the sheet storage case 4 and transmits information to the control device 16. A humidity detecting sensor 10 that is a "humidity detecting portion" detects the internal humidity of the sheet storage case 4 and transmits information to the control device 16.

A lifter plate 23 serving as a "sheet stacking portion" where the sheets 7*a* can be stacked is disposed in the sheet storage case 4 that is the "sheet feeding apparatus body". The lifter plate 23 is configured to be lifted and lowered in the sheet storage case 4. A duct 13 is disposed on the side of the lifter plate 23. A fan 11 that is a portion of the "heated air blowing portion" is disposed on an opening side of an outlet of the duct 13. The fan 11 blows "heated air" to a peripheral portion of the uppermost sheet 6 that is disposed at the uppermost position of the sheet 7*a* so as to loosen the sheet 7*a*, thereby preventing coat sheets from overlapping each other. A swing shutter 19 reciprocally moves in a "sheet loading direction", for example, an up-to-down direction, and blocks or passes a portion of the heated air blown from the fan 11 and loosens the sheet 7*a*. The swing shutter 19 is driven by a swing motor (not illustrated).

The sheet 7*a* is stacked on the lifter plate 23. The lifter plate 23 is lifted up to a position where the uppermost sheet 6 can always be detected by the sheet detecting sensor 8 serving as the "sheet bundle position detecting portion", by means of a lifter motor 512 (refer to FIG. 3) (which will be described in detail below) in a state where the sheet storage case 4 is closed.

Further, the lifter plate 23 includes a sheet existence/non-existence detecting sensor 21 and a lifter plate lower limit detecting sensor 22. The sheet existence/non-existence detecting sensor 21 detects whether or not the sheet 7*a* exists on the lifter plate 23. The sheet existence/non-existence detecting sensor 21 is used in order to detect when the sheet 7*a* is replaced in a state where the sheet storage case 4 is opened. However, when the sheet 7*a* is extracted from the sheet storage case 4, all of "storage periods of time" are cleared. The sheet existence/non-existence detecting sensor 21 can detect whether the sheet exists or not, regardless of a state where the sheet storage case 4 is closed or a state where the sheet storage case 4 is opened.

The lifter plate lower limit detecting sensor 22 detects a movement amount by which the lifter plate 23 is moved to a floor face of the sheet storage case 4. As will be described in detail below, the lift-up amount of the lifter plate 23 is detected by the sheet detecting sensor 8 and the lifter plate lower limit detecting sensor 22, and an addition amount of the sheet bundle 7 is calculated based on the lift-up amounts before and after supplying the sheet 7*a*. Further, the sheet existence/non-existence detecting sensor 21 can detect whether the sheet exists or not, even though the sheet storage case 4 is opened.

The duct 13 is disposed on the side of the lifter plate 23. An air heater 14 is mounted in the duct 13. The air is sucked from the lower side of the duct 13, heated by the air heater 14, and discharged by the fan 11. The air heater 14 is set such that the heated air is blown to the sheet 7*a* before starting to feed the sheet 7*a* and during the feeding operation of the sheet 7*a*. Further, the air heater 14 may be set such that the heated air is blown to the sheet 7*a*, only before starting to feed the sheet 7*a* or the feeding operation of the sheet 7*a*. If an SSR 17 that is connected to an AC voltage 18 is controlled by the control device 16, the air heater 14 makes heat generated from an internal resistor and heats the air sucked from the lower side.

An air heater temperature detecting sensor 15 that is the "air heater temperature detecting portion" comes into contact with the air heater 14 and transmits information related to the temperature of the air heater 14 to the control device 16. The control device 16 performs an ON/OFF control operation on the AC voltage 18 and the SSR 17 based on the information transmitted from the air heater temperature detecting sensor 15. A control condition of the control device 16 is a temperature condition. The control device 16 performs temperature control based on a temperature table (refer to FIGS. 6A and 6B) and a temperature correction table (refer to FIG. 7), which will be described in detail below, such that the temperature of the air heater 14 has a constant value. The detailed control will be described below. Further, in regards to an error detecting method of the air heater 14, a control operation is performed such that the air heater temperature detecting sensor 15 is used to output a high temperature error, when the temperature reaches the predetermined temperature or more. Further, when the temperature does not reach the predetermined temperature even though a predetermined time passes after a driving signal of the air heater 14 is output from the control device 16, the air heater temperature detecting sensor 15 is used to output a low temperature error. However, in regards to the low temperature error of the air heater 14, a control operation is performed such that the low temperature error is displayed on the operation screen 30 only when the low temperature error of a cassette heater 40 (which will be described in detail below) is also simultaneously generated.

A cassette heater temperature detecting sensor 41 that is a "cassette heater temperature detecting portion" comes into contact with the cassette heater 40 and transmits temperature information related to the cassette heater 40 to the control device 16. Similar to the air heater 14, the control device 16 performs an ON/OFF control operation on the AC voltage 18 and the SSR 17 based on the information transmitted from the cassette heater temperature detecting sensor 41. However, in regards to the cassette heater 40, supplying of power to the cassette heater 40 may be controlled based on the values that are calculated by the temperature detecting sensor 9 and the humidity detecting sensor 10.

Figure 3:
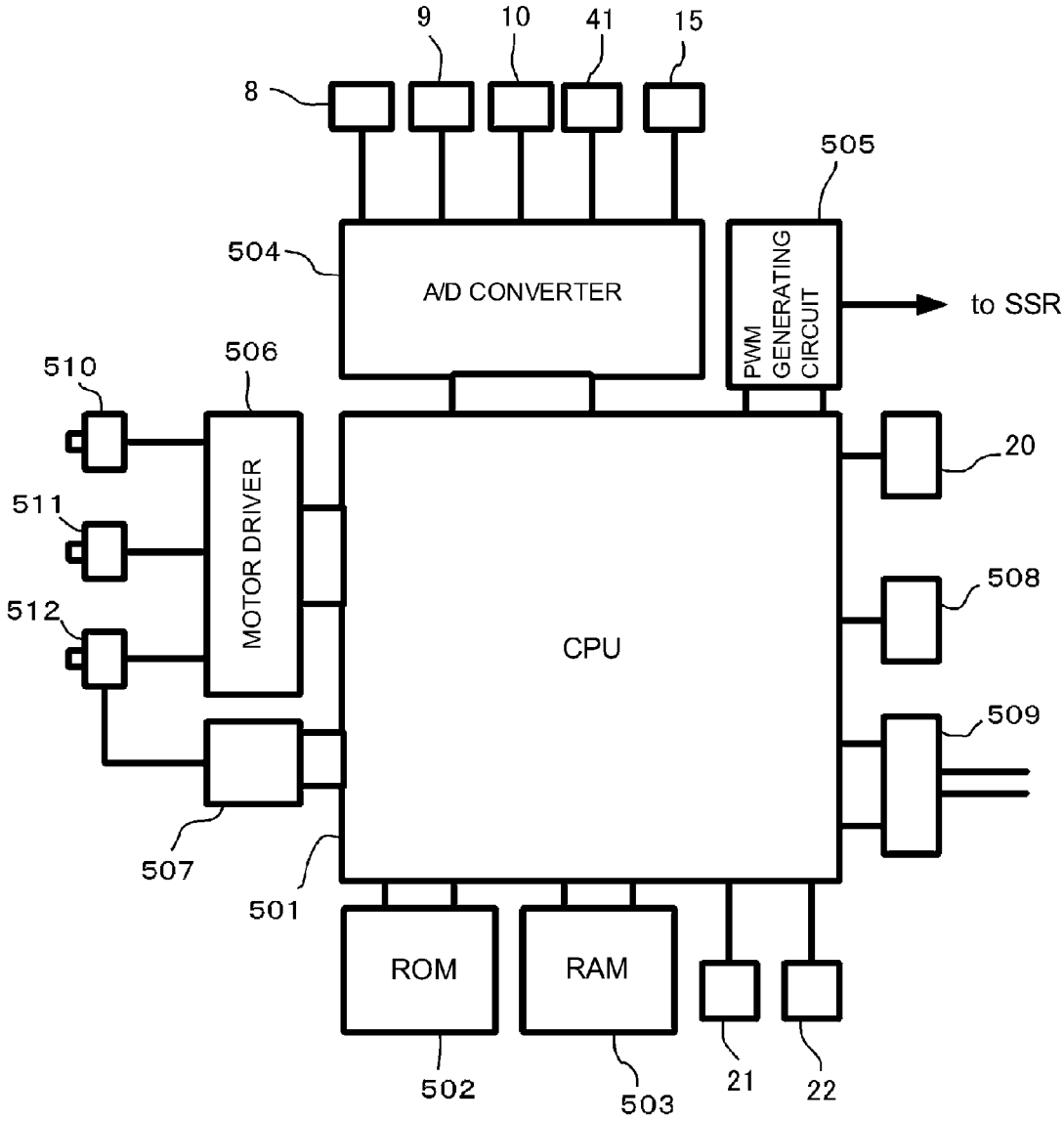
FIG. 3 is a block diagram illustrating a control device.

FIG. 3 is a block diagram illustrating a control device 16. A CPU 501 executes a program that is used to perform each driving control operation on the sheet storage case 4. As illustrated at the lower side of FIG. 3, the CPU 501 is connected to a RAM 503 and a ROM 502. The detailed contents of the ROM 502 will be described below with reference to FIG. 4 and the detailed contents of the RAM will be described below with reference to FIG. 5. Further, the CPU 501 is connected to the sheet existence/non-existence detecting sensor 21 that is the "sheet existence/non-existence detecting portion" and the lifter plate lower limit detecting sensor 22 serving as the "sheet surface position detecting portion" that is the "sheet bundle position detecting portion".

As illustrated at the upper side of FIG. 3, the CPU 501 is connected to an A/D converter 504, and the A/D converter 504 is connected to a sheet detecting sensor 8, a temperature detecting sensor 9, a humidity detecting sensor 10, a cassette heater temperature detecting sensor 41, and an air heater temperature detecting sensor 15. Analog values that are input from the various sensors 8, 9, 10, 41, and 15 are converted into digital values that enable analog levels to be determined by the CPU 501. A PWM generating circuit 505 can generate an ON/OFF pulse with respect to the SSR 17 that has been described with reference to FIG. 2.

As illustrated at the left side of FIG. 3, the CPU 501 is connected to a motor driver 506 and a pulse encoder 507. The motor driver 506 and the pulse encoder 507 are connected to the lifter motor 512 serving as a "sheet surface lifting mechanism". The lifter motor 512 lifts a sheet surface of the uppermost sheet 6 up to the predetermined position, after the sheet bundle 7 is supplied. Further, the pulse encoder 507 measures the number of driving pulses when the lifter motor 512 is driven. Information of the number of driving pulses is received by the CPU 501, and the CPU 501 measures the position of the lifter plate 23 of the sheet storage case 4 based on the number of driving pulses. Further, the motor driver 506 drives the lifter motor 512 that drives the lifter plate 23 as described above. In addition, the motor driver 506 is connected to a conveyance motor 510 that drives the conveying roller and a swing shutter driving motor 511 that drives the swing shutter, and drives the conveyance motor 510 and the swing shutter driving motor 511.

As illustrated at the right side of FIG. 3, the CPU 501 can operate a solenoid to open the sheet storage case 4 by operating an opening solenoid switch 20. Further, the CPU 501 operates a fan driving driver 508, thereby operating the fan 11. Further, the CPU 501 can communicate with the copying machine 1 through a serial communication driver 509. In particular, although not illustrated in the drawings, the CPU 501 has a clock that is provided in the CPU 501 and can recognize an arbitrary time. Although not illustrated in the drawings, even in the configuration where the CPU 501 obtains temporal information from the copying machine 1 through the serial communication driver 509, it is obvious that the same effect can be obtained.

Figure 4:
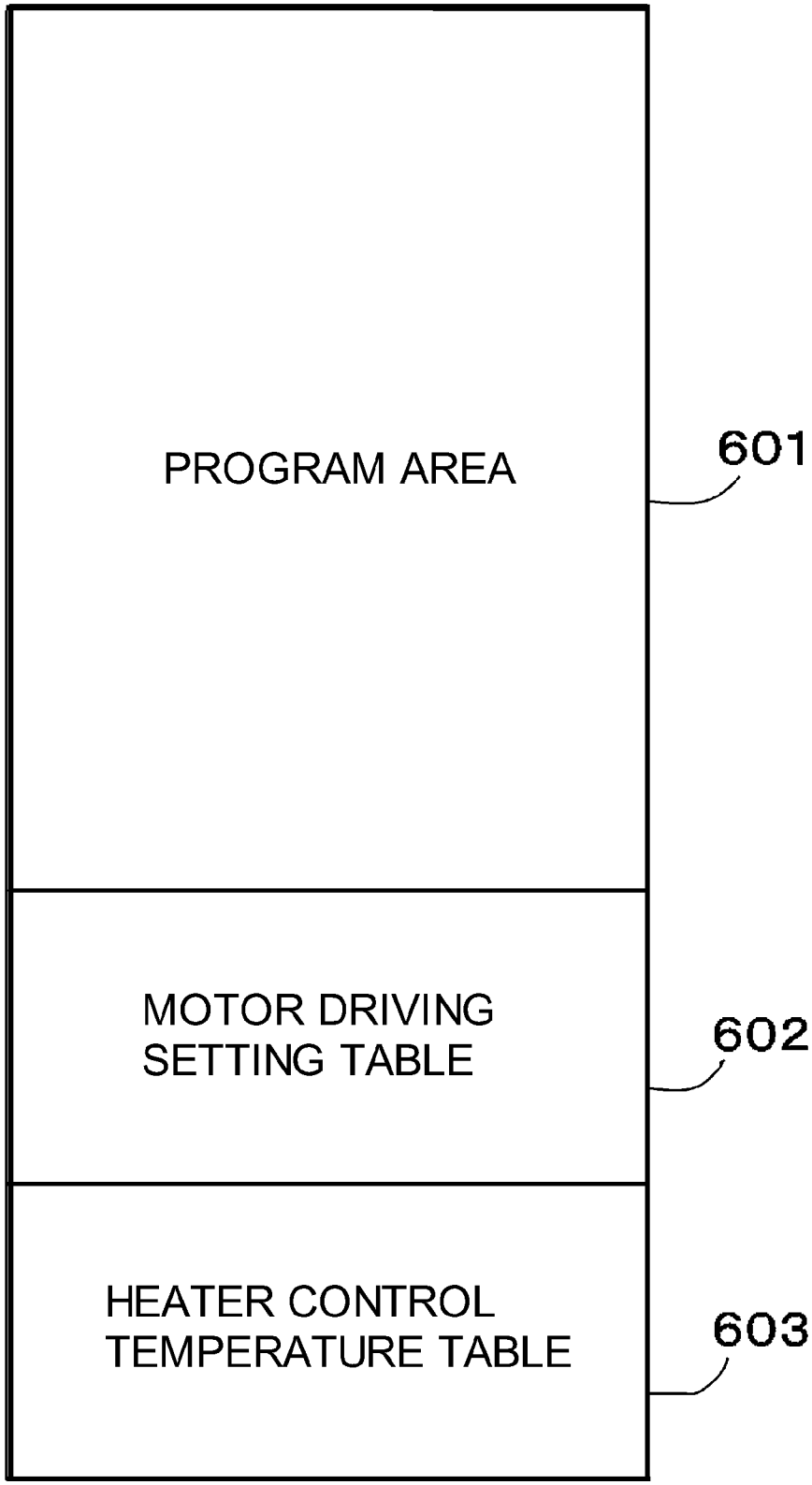
FIG. 4 is a diagram illustrating an address map of a ROM.

FIG. 4 is a diagram illustrating an address map of a ROM 502. The ROM 502 stores a program area 601, a motor driving setting table 602, and a heater control temperature table 603. The program area 601 stores a control program body and data. The motor driving setting table 602 stores driving parameters, such as a driving speed or an acceleration rate, which are needed to drive the conveyance motor 510, the swing shutter driving motor 511, and the lifter motor 512. The heater control temperature table 603 stores a temperature table (refer to FIGS. 6A and 6B) for heater control (which will be described in detail below) or a temperature correction table (refer to FIG. 7) for heater control (which will be described in detail below).

Figure 5:
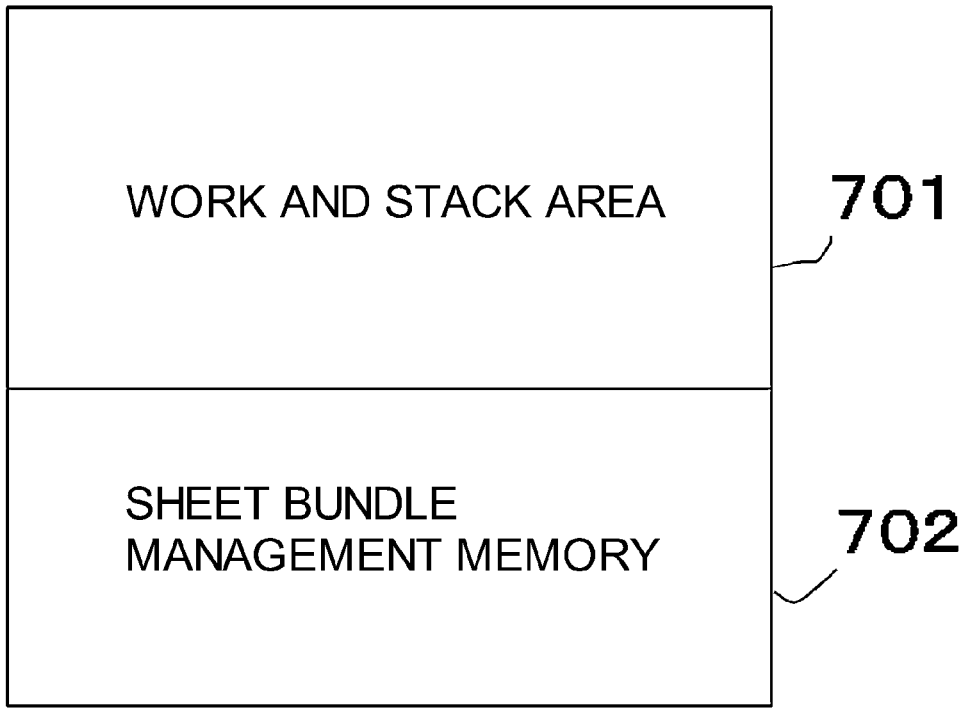
FIG. 5 is a diagram illustrating an address map of a RAM.

FIG. 5 is a diagram illustrating an address map of a RAM 503. The RAM 503 stores a work and stack area 701 and a sheet bundle management memory 702. The work and stack area 701 is a work and stack area that is needed to execute a program. The sheet bundle management memory 702 stores information (refer to FIGS. 8A to 8D) that is related to the sheet bundle 7, which will be described in detail below.

In the above configuration, the operation until the air heater 14 starts to adjust the temperature and loosens the sheet 7*a* and the pick-up roller 5 starts to feed the sheet will be described. First, the control device 16 determines an optimal air heater target temperature based on the "temperature and humidity information" transmitted from the temperature detecting sensor 9 and the humidity detecting sensor 10 to the control device 16 and the "sheet information" transmitted from the sheet detecting sensor 8 to the control device 16. Specifically, the "sheet information" includes information that is related to the thickness, density, and size of the sheet.

Figure 6A:
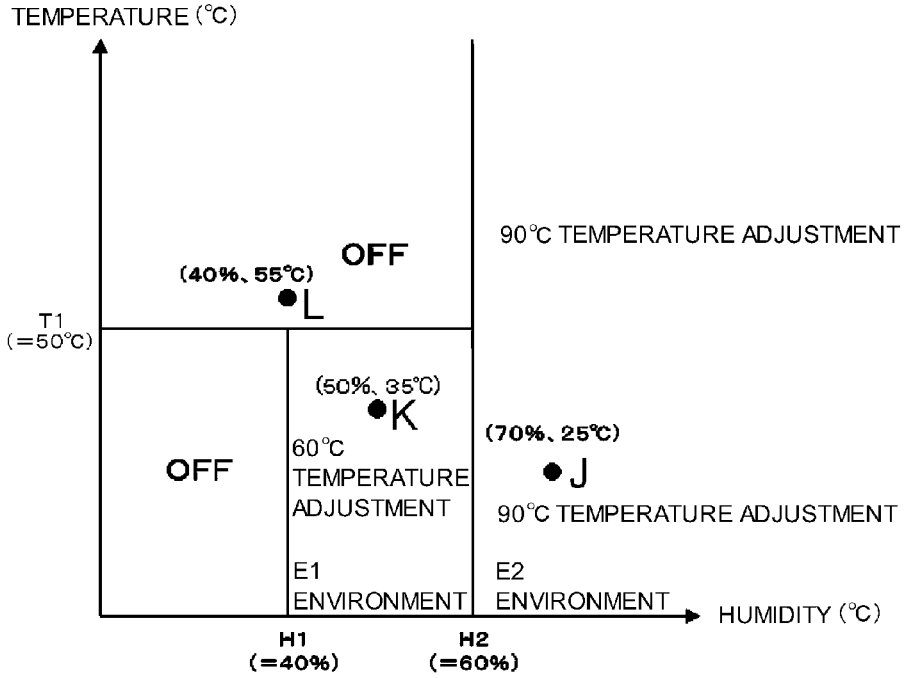
FIGS. 6A and 6B are diagrams illustrating temperature tables for heater control.
Figure 6B:
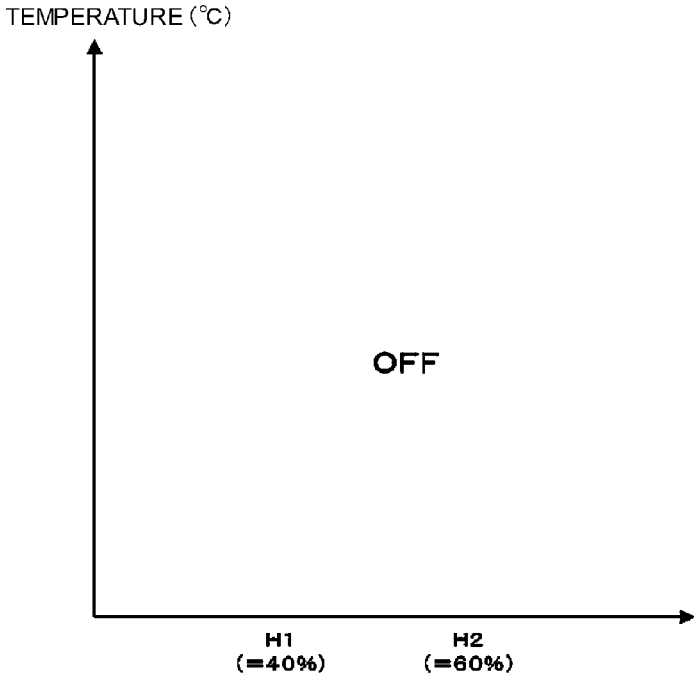

FIGS. 6A and 6B illustrate temperature tables for heater control. As illustrated in FIGS. 6A and 6B, the target temperature of the air heater 14 that serves as the "heated air blowing portion" is set. First, as illustrated in FIG. 6A, it is assumed that the sheet detecting sensor 8 determines a sheet P stored in the sheet storage case 4 as a coat sheet.

As illustrated by a dot J, it is assumed that the temperature detecting sensor 9 detects the internal temperature of the sheet storage case 4 as 25° C. and the humidity detecting sensor 10 detects the internal humidity of the sheet storage case 4 as 70%. In this case, the target temperature of the air heater 14 is set to 90° C. Here, an environment where the temperature is adjusted to 90° C. is called an E2 environment. The E2 environment is a target environment that is set when the humidity is H2 (=60%) or more. If the control device 16 determines that the internal temperature of the sheet storage case 4 is 90° C. or less based on the information transmitted from the air heater temperature detecting sensor 15, the control device 16 turns on a power supply device of the SSR 17 such that power is supplied to the air heater 14, thereby increasing the temperature. In contrast, if the control device 16 determines that the internal temperature of the sheet storage case 4 is higher than 90° C., the control device 16 turns off the power supply device of the SSR 17 such that supplying of power to the air heater 14 is stopped.

Next, as illustrated by a dot K, it is assumed that the temperature detecting sensor 9 detects the internal temperature of the sheet storage case 4 as 35° C. and the humidity detecting sensor 10 detects the internal humidity of the sheet storage case 4 as 50%. In this case, the target temperature of the air heater 14 is set to 60° C. Here, an environment where the temperature is adjusted to 60° C. is called an E1 environment. The E1 environment is a target environment that is set when the temperature is T1 (=50° C.) or less in the case where the humidity is H2 (=40 to 60%). If the control device 16 determines that the internal temperature of the sheet storage case 4 is 60° C. or less based on the information transmitted from the air heater temperature detecting sensor 15, the control device 16 turns on the power supply device of the SSR 17 such that power is supplied to the air heater 14, thereby increasing the temperature. In contrast, if the control device 16 determines that the internal temperature of the sheet storage case 4 is higher than 60° C., the control device 16 turns off the power supply device of the SSR 17 such that supplying of power to the air heater 14 is stopped.

Next, as illustrated by a dot L, it is assumed that the temperature detecting sensor 9 detects the internal temperature of the sheet storage case 4 as 55° C. and the humidity detecting sensor 10 detects the internal humidity of the sheet storage case 4 as 40%. In this case, the air heater 14 is turned off (this case is described as "OFF" in the drawings, which is applicable to the following description). As such, the case where the air heater 14 is turned off corresponds to the case where the internal humidity of the sheet storage case 4 is lower than H2 (=60%) and the temperature thereof is higher than T1 (=50° C.). Further, the case where the air heater 14 is turned off corresponds to the case where the internal humidity of the sheet storage case 4 is lower than H1 (=40%) and the temperature thereof is lower than T1 (=50° C.). However, the chart that is illustrated in FIG. 6A is exemplary. Although the temperature table needs to be more minutely divided as an optimal temperature adjustment specification, the temperature table is simply illustrated herein.

Next, as illustrated in FIG. 6B, it is assumed that the sheet detecting sensor 8 determines the sheet P stored in the sheet storage case 4 as a non-coat sheet. In this case, power is not supplied to the air heater 14. That is, the control device 16 continuously maintains a state where the SSR 17 is turned off. However, the chart of FIG. 6B is exemplary. Although the temperature table needs to be more minutely divided as an optimal temperature adjustment specification, the temperature table is simply illustrated herein.

FIG. 7 illustrates a temperature correction table for heater control. As illustrated in FIG. 7, when the control device 16 determines that the sheet P is a coat sheet and an internal environment of the sheet storage case 4 is an E1 environment, a correction temperature is different depending on a waiting time that is a "storage period of time" of the sheet P in the sheet storage case 4. For example, if the waiting time is within the "predetermined period of time", for example, 2 hours, the correction temperature is set as 0° C. as the "temperature where correction is not made", which is the "first target temperature".

If the waiting time passes the "predetermined period of time" and is not less than 2 hours and less than 24 hours, the correction temperature is set as −10° C. as the "temperature where correction is made", which is the "second target temperature". If the waiting time passes the "predetermined period of time" and is not less than 24 hours, the correction temperature is set as −15° C. as the "temperature where correction is made", which is the "second target temperature".

When the control device 16 determines that the sheet P is a coat sheet and an internal environment of the sheet storage case 4 is an E2 environment, a correction temperature is different depending on a waiting time that is the "storage period of time" of the sheet P in the sheet storage case 4, in the same way as the above. For example, if the waiting time is within the "predetermined period of time", for example, 2 hours, the correction temperature is set as 0° C. as the "temperature where correction is not made", which is the "first target temperature".

If the waiting time passes the predetermined period of time and is not less than 2 hours and less than 24 hours, the correction temperature is set as −15° C. as the "temperature where correction is made", which is the "second target temperature". If the waiting time passes the predetermined period of time and is not less than 24 hours, the correction temperature is set as −30° C. as the "temperature where correction is made", which is the "second target temperature".

As such, the "second target temperature" is set to be lower than the "first target temperature". When the sheet P is a non-coat sheet, the correction temperature is set as 0° C., regardless of whether the internal environment is the E1 environment or the E2 environment. When the correction temperature is set as 0° C., the air heater 14 is not controlled.

Accordingly, the target temperature of the air heater 14 is corrected in accordance with the storage period of time of the sheet 7*a* starting from a point of time when the sheet bundle 7 is stored in the sheet storage case 4. For example, as illustrated by the dot K in FIG. 6A, it is assumed that the sheet bundle 7 is a coat sheet bundle, the internal temperature of the sheet storage case body 4*a* is 35° C., and the humidity thereof is 50%. In this case, the controlled target temperature is 60° C. In addition, it is assumed that the sheet bundle 7 of the coat sheets is stored for 5 hours under the E1 environment. In this case, the temperature of 10° C. is subtracted from the target temperature of 60° C. As a result, the target temperature after the correction becomes 50° C. Further, when the sheet 7*a* is a non-coat sheet, the air heater 14 is not operated. Therefore, the correction temperature is 0° C. and the target temperature stays 60° C.

Figures 8A, 8B, 8C, 8D:
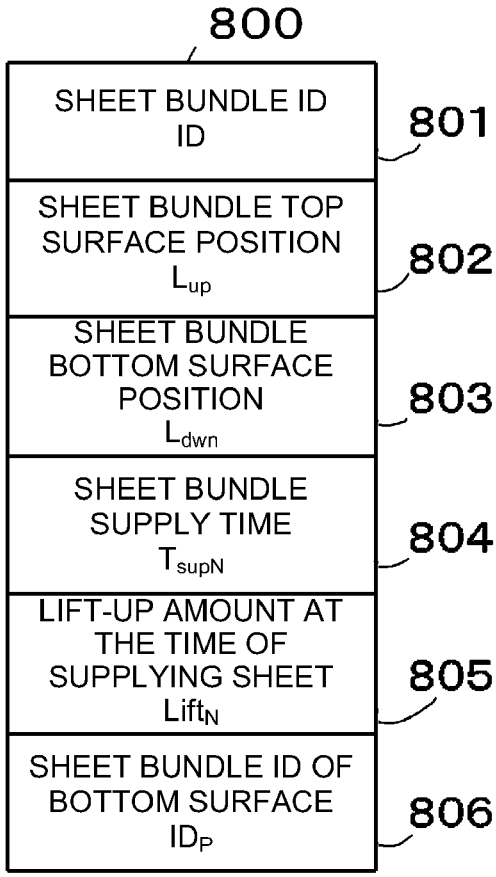
FIGS. 8A to 8D are diagrams illustrating a data structure related to a sheet bundle, that is, a sheet bundle management memory.

FIG. 8A is a schematic diagram illustrating a format of a data structure that is related to a sheet bundle 7. A data structure 800 of the sheet bundle management memory includes a sheet bundle ID 801, a sheet bundle top surface position 802, a sheet bundle bottom surface position 803, a sheet bundle supply time 804, a lift-up amount 805 at the time of supplying sheets, and a sheet bundle ID 806 of a bottom surface. The data structure 800 of the sheet bundle management memory stores a "sheet bundle position" detected by the sheet detecting sensor 8 and the lifter plate lower limit detecting sensor 22, that is, a sheet bundle top surface position 802 and a sheet bundle bottom surface position 803 as "position information", for "every sheet bundle", that is, every sheet bundle 7. The data structure 800 functions as a "position storage portion". Further, the data structure 800 of the sheet bundle management memory 702 functions as a "supply time storage portion" that stores a sheet bundle supply time 804 recognized by a clock as "supply time information", for every sheet bundle 7. The sheet bundle ID (ID) 801 is an ID that is used to identify each sheet bundle. An area of the ID 801 is assigned with a number of 1, 2, . . . , in the order of sheet bundles disposed at lower positions.

The sheet bundle top surface position (Lup) 802 is a top surface position of the sheet bundle 7 that is supplied to the lifter plate 23. The number of driving pulses of the lifter motor 512 is stored in an area of the Lup 802. In this case, uppermost surface position information such as the sheet bundle top surface position 802 that is detected whenever the sheet bundle 7 is stacked on the lifter plate 23 is stored for every sheet bundle 7. In the case where no sheet 7*a* exists on the lifter plate 23, the Lup 802 becomes 0, when the lifter plate 23 is disposed at the lowest position.

The sheet bundle bottom surface position (Ldwn) 803 is a bottom surface position of the sheet bundle 7 that is supplied to the lifter plate 23. The number of driving pulses of the lifter motor 512 is stored in the area of the Ldwn 803. In this case, lowermost surface position information such as the sheet bundle bottom surface position 803 that is detected whenever the sheet bundle 7 is stacked on the lifter plate 23 is stored for every sheet bundle 7. Regardless of whether or not the sheet 7*a* exists on the lifter plate 23, the Ldwn 803 becomes 0, when the lifter plate 23 is disposed at the lowest position.

The sheet bundle top surface position (Lup) 802 and the sheet bundle bottom surface position (Ldwn) 803 will be described in detail below with reference to FIGS. 10A to 10F.

The sheet bundle supply time (TsupN) 804 is a time when the sheet bundle 7 is supplied and the sheet storage case 4 is closed. The supply time information that is related to a supply time of the sheet bundle 7 that is detected whenever the sheet bundle 7 is stacked on the lifter plate 23 is stored for every sheet bundle 7. The lift-up amount (LiftN) 805 at the time of supplying the sheet bundle is a movement amount by which the lifter plate 23 is lifted when the sheet bundle 7 is supplied and the sheet storage case 4 is closed, that is, a displacement. The number of driving pulses of the lifter motor 512 is stored in the area of the LiftN 804.

In the sheet bundle ID (IDp) 806 of the bottom surface, the sheet bundle ID (ID) 801 of the sheet bundle 7 that is previously stacked below the newly stacked sheet bundle 7 is stored.

Further, the sheet bundle top surface position (Lup) 802, the sheet bundle bottom surface position (Ldwn) 803, and the lift-up amount (LiftN) 805 at the time of supplying the sheet bundle are used as "position information".

FIGS. 8B to 8D are schematic diagrams illustrating utilization embodiments of a data structure that is related to a sheet bundle 7. When the lifter plate 23 where the sheet bundle 7 is not placed is lifted up, the number of driving pulses of the lifter motor 512 is set as 1000. In this case, it is assumed that the sheet bundles 7 are supplementally stacked.

A data structure 807 of the sheet bundle management memory indicates a data structure that is related to the sheet bundle 7 stored in a lowermost portion of the lifter plate 23. As illustrated in FIG. 8B, since the sheet bundle 7 is first placed on the lifter plate 23, the data structure that is related to ID=1 is assigned. Since the sheet bundle 7 is disposed in the lowermost portion of the lifter plate 23, Ldwn becomes 0. If the lift-up amount LiftN at the time of supplying the sheet bundle 7 is set to 850, the sheet bundle top surface position Lup becomes 150. In this case, 07.07.10.16:40 is recorded as the sheet bundle supply time TsupN. Since another sheet bundle 7 does not exist below the sheet bundle 7, IDp=0 is assigned.

Next, a data structure 808 of the sheet bundle management memory indicates a data structure that is related to the sheet bundle 7 stored on the sheet bundle 7 stacked on the lifter plate 23. As illustrated in FIG. 8C, since the sheet bundle 7 is secondly placed on the lifter plate 23, ID=2 is assigned. Since the sheet bundle 7 is disposed on the sheet bundle 7 that is stacked on the lifter plate 23, Ldwn becomes 150. If the lift-up amount LiftN at the time of supplying the sheet bundle 7 is set to 530, the sheet bundle top surface position Lup becomes 470. In this case, 07.07.10.21:12 is recorded as the sheet bundle supply time TsupN. Since another sheet bundle 7 exists below the sheet bundle 7, IDp=1 is assigned.

Next, a data structure 809 of the sheet bundle management memory indicates a data structure that is related to the sheet bundle 7 disposed on the sheet bundle 7 stacked on the lifter plate 23. As illustrated in FIG. 8D, since the sheet bundle 7 is thirdly placed on the lifter plate 23, ID=3 is assigned. Since the sheet bundle 7 is placed on the sheet bundles 7 that are stacked on the lifter plate 23, Ldwn becomes 470. If the lift-up amount LiftN at the time of supplying the sheet bundle 7 is set to 170, the sheet bundle top surface position Lup becomes 830. In this case, 07.07.10.23:37 is recorded as the sheet bundle supply time TsupN. Since another sheet bundle 7 exists below the sheet bundle 7, IDp=2 is assigned.

As such, if the new sheet bundle 7 is additionally disposed on the sheet bundle 7 that is stored on the lifter plate 23, a new sheet bundle management memory is added to in RAM 503. In particular, although not illustrated in the drawings, when the sheet storage case 4 is opened and all of the sheet bundles 7 in the sheet storage case 4 are extracted, all of the sheet bundle management memories are cleared. Although not illustrated in the drawings, the sheet bundle management memory is cleared in regard to the sheet bundle 7 where all of the sheets 7*a* are fed.

Figure 9:
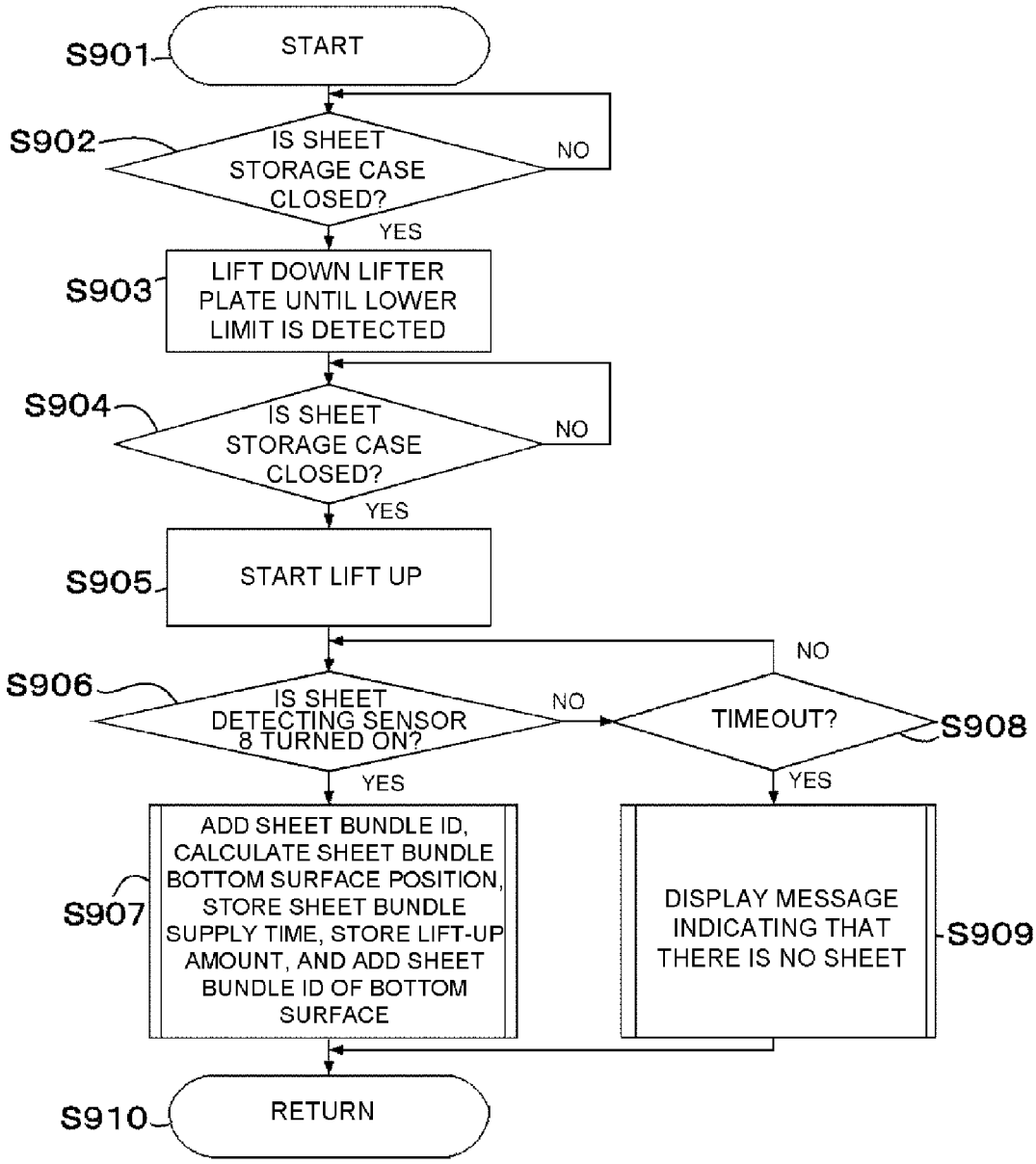
FIG. 9 is a flowchart illustrating a process of supplying a sheet bundle to a lifter plate by opening and closing a sheet storage case.

FIG. 9 is a flowchart illustrating a process of supplying a sheet bundle 7 to a lifter plate 23 by opening and closing a sheet storage case 4. The control device 16 starts an algorithm at the time of opening and closing the sheet storage case 4 (Step 901, hereinafter, a "Step" is simply referred to as "S"). The control device 16 determines whether the sheet storage case 4 is opened or not (S902). At this time, in the case of YES, in accordance with an instruction from the control device 16, the lifter plate 23 is lifted down up to a position where the lifter plate lower limit detecting sensor 22 is turned on (S903). In this state, an operator supplements the sheets 7*a* in the sheet storage case 4. In the case of NO, the control device 16 determines again whether the sheet storage case 4 is opened or not (S902).

Next, if the lifter plate 23 is lifted down (S903), the sheet bundle 7 is placed on the lifter plate 23. Then, the control device 16 determines whether the sheet storage case 4 is closed or not (S904). At this time, in the case of YES, the control device 16 starts to lift up the lifter plate 23 (S905). The control device 16 monitors whether the sheet detecting sensor 8 is turned on or not (S906). In the case of YES, the control device 16 generates a new sheet bundle management memory (S907). When the new sheet bundle management memory is generated, a sheet bundle ID is added, a sheet bundle bottom surface position is calculated, a sheet bundle supply time is stored, the lift-up amount as a "movement distance" is stored, and a sheet bundle ID of a bottom surface is added (S907).

In the case of NO, the control device 16 monitors whether a predetermined time passes, that is, a time-out is made (S908). In the case of YES, the control device 16 displays a message, which indicates that the sheet bundle 7 does not exist in the sheet storage case 4, on a display portion (not illustrated) (S909). In the case of NO, the control device 16 monitors again whether the sheet detecting sensor 8 is turned on or not (S906). If a new sheet bundle management memory is generated, the algorithm is returned (S910). The algorithm of when the sheet storage case 4 is opened and closed starts (S901).

Figure 10A:
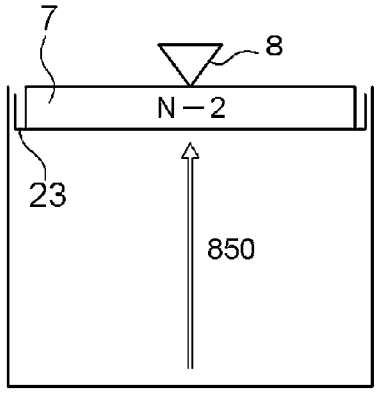
FIGS. 10A to 10F are schematic diagrams illustrating a positional relationship between a lifer plate and a sheet bundle in the case of supplying a sheet bundle.
Figure 10B:
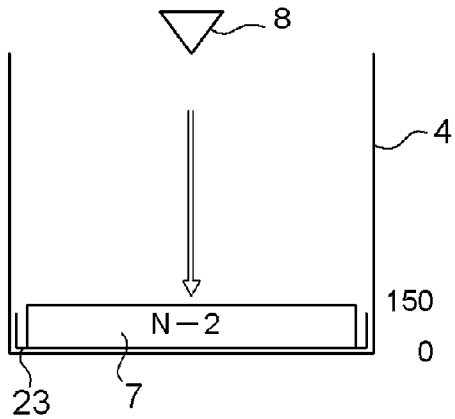
Figure 10C:
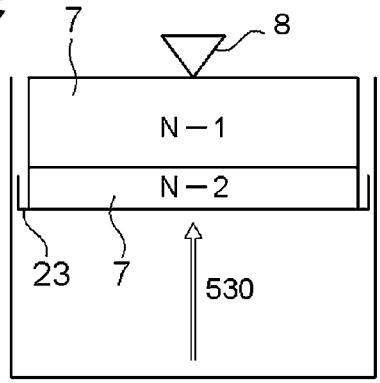
Figure 10D:
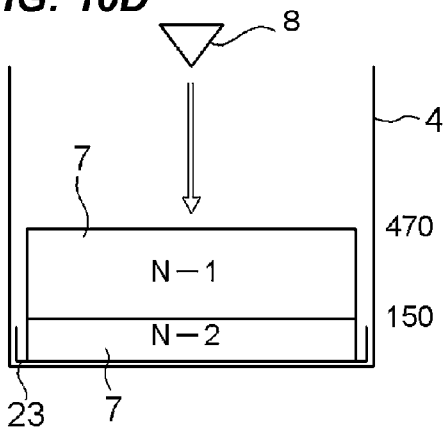
Figure 10E:
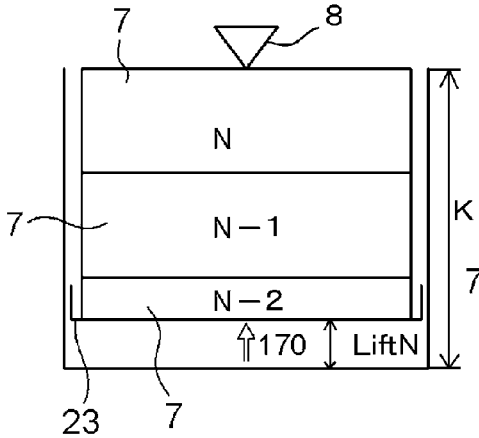
Figure 10F:
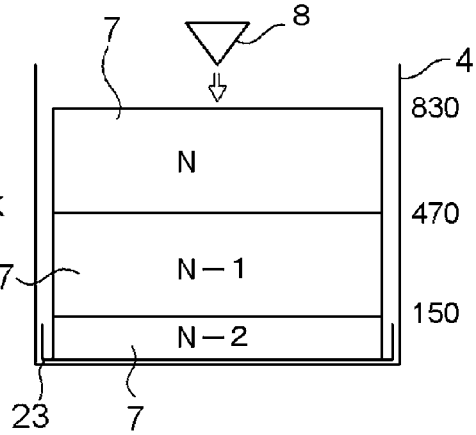

FIGS. 10A to 10F are schematic diagrams illustrating a positional relationship between a lifter plate 23 and a sheet bundle 7 when a sheet bundle is supplied. As illustrated in FIGS. 10A, 10C, and 10E, when the sheet storage case 4 is closed, the lifter plate 23 is lifted up until the uppermost sheet 6 of the sheet bundle 7 comes into contact with the sheet detecting sensor 8 and the sheet detecting sensor 8 is turned on. As illustrated in FIGS. 10B, 10D, and 10F, when the sheet storage case 4 is opened, the lifter plate 23 is lifted down up to the bottom surface of the sheet storage case 4, and the sheet bundle 7 is supplemented again.

At this time, the driving pulses of the lifter motor 512 are counted, and the counted number is stored in the sheet bundle management memory in a form of ID=N. If the height from the bottom portion of the sheet storage case 4 to the sheet detecting sensor 8 corresponds to the pulse number of K, the sheet bundle top surface position Lup (N) of the supplemented sheet bundle is represented by the following Equation.

[Equation 1]

$$Lup(N)=K-LiftN \quad (1)$$

In the same way, the sheet bundle bottom surface position Ldwn (N) of the supplemented sheet bundle is represented by the following Equation.

[Equation 2]

$$Ldwn(N)=Lup(N-1) \quad (2)$$

In this way, the boundary of the sheet bundle 7 is recognized. Further, the control device 16 calculates the position information of the supplied sheet bundle 7 based on the lift-up amounts of the lifter plate 23 before and after supplying the sheet 7*a*, which are stored in a sheet bundle management memory 702.

Hereinafter, the case where the height from the bottom portion of the sheet storage case 4 to the sheet existence/non-existence detecting sensor 21 corresponds to the number of pulses of K=1000 is exemplified.

As illustrated in FIG. 10A, when the sheet bundle 7 at the (N−2)-th stage is stacked on the lifter plate 23, the lifter plate 23 is lifted up to a position where the uppermost sheet 6 of the sheet bundle 7 at the (N−2)-th stage comes into contact with the sheet detecting sensor 8. In this case, the lifter plate 23 is lifted up from the bottom surface of the sheet storage case 4, and moves up to the position where the uppermost sheet 6 comes into contact with the sheet detecting sensor 8. The lifter plate lower limit detecting sensor 22 detects LiftN=850 pulse number. In addition, as illustrated in FIG. 10B, if the lifter plate 23 moves to the bottom surface of the sheet storage case 4, the CPU 501 determines that the sheet bundle 7 at the (N−2)-th stage corresponds to Lup=150 pulse number and Ldwn=0 pulse number.

Next, as illustrated in FIG. 10C, when the sheet bundle 7 at the (N−1)-th stage is stacked on the sheet bundle 7 at the (N−2)-th stage, the lifter plate 23 is lifted up to a position where the uppermost sheet 6 of the sheet bundle 7 at the (N−1)-th stage comes into contact with the sheet detecting sensor 8. In this case, the lifter plate 23 is lifted up from the bottom surface of the sheet storage case 4, and moves up to the position where the uppermost sheet 6 comes into contact with the sheet detecting sensor 8. The lifter plate lower limit detecting sensor 22 detects LiftN=530 pulse number. In addition, as illustrated in FIG. 10D, if the lifter plate 23 moves to the bottom surface of the sheet storage case 4, the CPU 501 determines that the sheet bundle 7 at the (N−1)-th stage corresponds to Lup=470 pulse number and Ldwn=150 pulse number.

Next, as illustrated in FIG. 10E, when the sheet bundle 7 at the N-th stage is stacked on the sheet bundle 7 at the (N−1)-th stage, the lifter plate 23 is lifted up to a position where the uppermost sheet 6 of the sheet bundle 7 at the N-th stage comes into contact with the sheet detecting sensor 8. In this case, the lifter plate 23 is lifted up from the bottom surface of the sheet storage case 4, and moves up to the position where the uppermost sheet 6 comes into contact with the sheet detecting sensor 8. The lifter plate lower limit detecting sensor 22 detects LiftN=170 pulse number. In addition, as illustrated in FIG. 10F, if the lifter plate 23 moves to the bottom surface of the sheet storage case 4, the CPU 501 determines that the sheet bundle 7 at the N-th stage corresponds to Lup=830 pulse number and Ldwn=470 pulse number.

When the sheet bundles 7 at the (N−2)-th to N-th stages are stacked on the lifter plate 23 at different points of time, the "storage period of time" of the sheet bundle 7 that has the "largest thickness" is included as a reference and the target temperature of the heated air is set. In accordance with the "thickness", "storage period of time", and "disposition environment" of the sheet bundle 7, the control temperature of the air heater 14 is changed. As a result, optimal control is enabled.

When the sheet bundles 7 at the (N−2)-th to N-th stages are stacked on the lifter plate 23 at different points of time, the "storage period of time" of the sheet bundle 7 at the (N−2)-th stage as the lowest stage is included as a reference and the target temperature of the heated air may be set. Alternatively, the target temperature of the heated air may be set based on the "storage period of time" and the "thickness" of the sheet bundle 7 at the (N−2)-th stage as the lowest stage.

Based on a combination of parameters such as the "storage period of times" and the "thicknesses" of the individual sheet bundles 7 until the sheet bundle 7 at the N-th stage as the uppermost stage from the sheet bundle 7 at the (N−2)-th stage as the lowest stage, the target temperature can be more minutely set.

Further, the sheet bundle 7 that previously is stored on the lifter plate 23 corresponds to the "previously stored sheets", and the sheet bundle 7 that is added to the "previously stored sheets" corresponds to the "added sheets".

Figure 11:
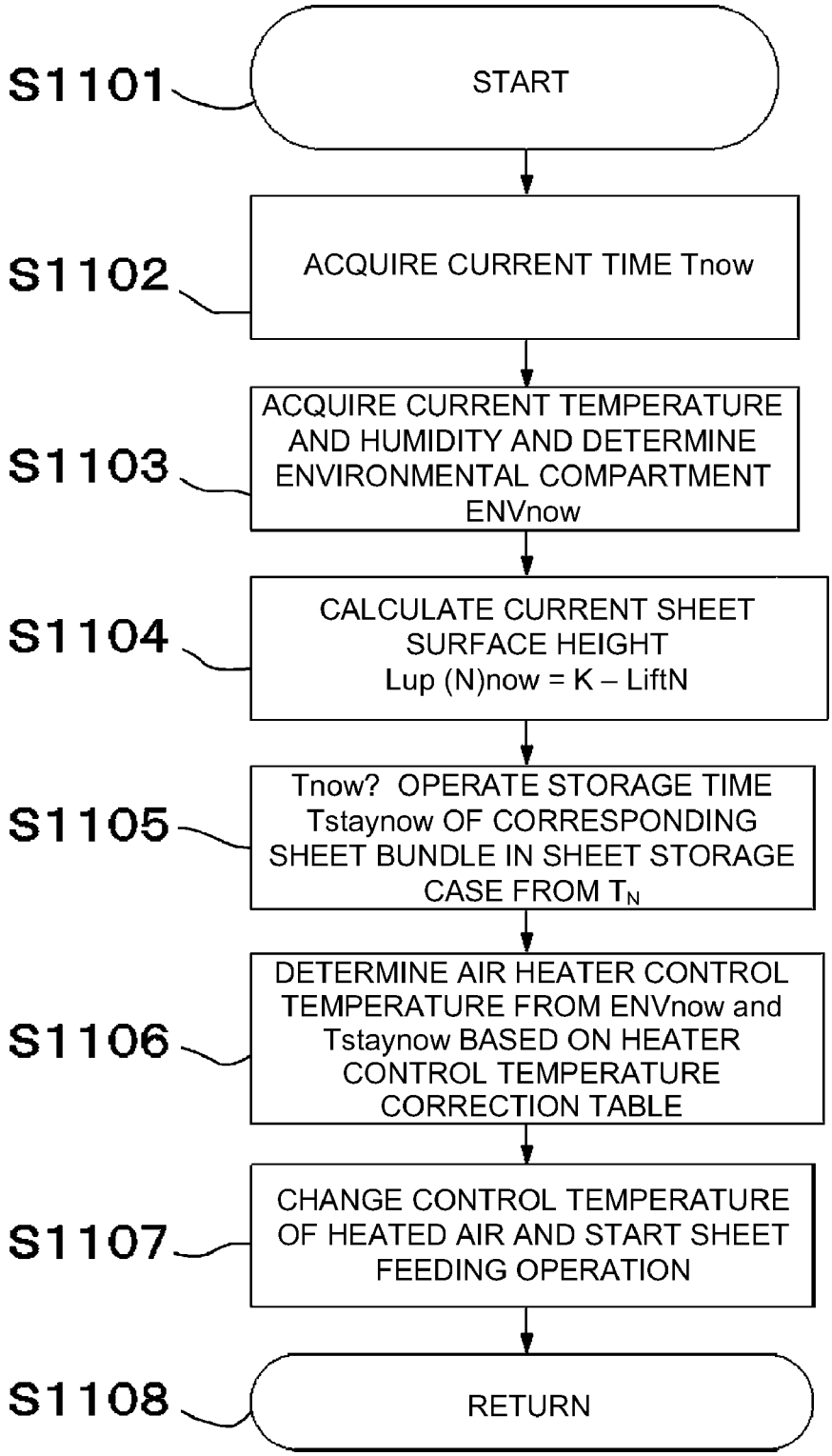
FIG. 11 is a flowchart illustrating a feeding operation of when a sheet bundle is fed from a sheet storage case.

FIG. 11 is a flowchart illustrating a feeding operation of when a sheet bundle 7 is fed from a sheet storage case 4. The control device 16 starts the operation of the feeding portion (S1101). When the sheet bundle 7 is fed, first, the control device 16 acquires the current time Tnow (S1102). Next, the control device 16 acquires the current temperature and humidity by the temperature detecting sensor 9 and the humidity detecting sensor 10, and determines an environmental compartment ENVnow (S1103). The control device 16 calculates the height of the shift surface (Lup(N)now=K−LiftN) from the current lifter plate 23 (S1104). In particular, although not illustrated in the drawings, the CPU 501 always detects the height of the sheet surface using the driving pulses of the lifter motor 512.

Since the sheet bundle 7 is the sheet bundle 7 whose sheet bundle ID has the largest value, a difference Tstaynow between the current time Tnow and the time when the sheet bundle 7 is supplemented in the sheet storage case 4 is operated (S1105).

Next, based on ENVnow and Tstaynow, the control temperature of the air heater 14 is determined from the temperature table for heater control illustrated in FIGS. 6A and 6B and the temperature correction table for heater control illustrated in FIG. 7. The control temperature of the heated air is changed and the feeding operation starts (S1107). The process is returned to the feeding operation (S1108).

According to the embodiment of the present invention, the control device 16 changes a control condition of the heated air based on the storage period of time of the sheet 7*a* that is stored in the sheet storage case 4. Accordingly, the amount of moisture that is contained in the sheet 7*a* is varied depending on the storage period of time of the sheet 7*a* in the sheet storage case 4. When the storage period of time is decreased, the amount of moisture that is contained in the sheet 7*a* is increased. When the storage period of time is increased, the amount of moisture that is contained in the sheet 7*a* is decreased. The control device 16 changes the control condition of the heated air based on the storage period of time of the sheet 7*a* and a state of the heated air is adjusted in accordance with the amount of moisture that is contained in the sheet 7*a*. In this case, the amount of moisture that is contained in the sheet 7*a* is always maintained at a constant level. As a result, the amount of moisture contained in the sheet 7*a* can be prevented from being excessively increased and decreased, a conveyance defect of the sheet 7*a* or an image formation defect on the sheet 7*a* is suppressed, and a high-quality printed material is stably output. Further, an expensive measuring apparatus that measures a contained moisture amount does not need to be provided in order to estimate the amount of moisture contained in the sheet 7*a*.

Further, the control device 16 changes the temperature condition of the heated air and the amount of moisture contained in the sheet 7*a* is varied depending on a degree of evaporation.

Further, when the storage period of time of the sheet 7*a* is short, the temperature is set to a relatively high first target temperature. When the storage period of time of the sheet 7*a* is long, the temperature is set to a relatively low second target temperature. Accordingly, the sheet 7*a* where the storage period of time is long is not heated at the unnecessarily high temperature. As a result, the sheet 7*a* where the storage period of time is long can maintain the contained moisture amount more properly than the related art.

Further, if the storage period of time of the sheet 7*a*, the internal temperature and humidity of the sheet storage case 4, and the types of the sheets 7*a* are combined and the control condition is changed, the control condition of the heated air is precisely set.

Further, the sheet detecting sensor 8 detects the position of the sheet bundle 7 whenever the sheet bundle 7 is newly stacked on the lifter plate 23. Based on the position information that is related to the plurality of sheet bundles 7, the control condition of the sheet 7*a* is step-wisely changed. In actuality, the control condition of the sheet 7*a* is changed based on the sheet bundle 7 that is stored on the lifer plate 23 for a longest period of time.

Further, the control condition of the sheet 7*a* is step-wisely changed based on the supply time information that is related to the supply times of the plurality of sheet bundles 7. In actuality, the control condition of the sheet 7*a* is changed based on the sheet bundle 7 that is stored on the lifer plate 23 for a longest period of time.

Further, as described above, the image forming apparatus may be configured using the image forming portion, such as the sheet feeding apparatus 80 and the photosensitive drum 111.

While the present invention has been described with reference to exemplary embodiments, it is to be understood that the invention is not limited to the disclosed exemplary embodiments. The scope of the following claims is to be accorded the broadest interpretation so as to encompass all such modification and equivalent structures and functions.

This application claims the benefits of Japanese Patent Application No. 2008-151280, filed Jun. 10, 2008, which is hereby incorporated by reference herein in its entirety.

What is claimed is:

1. A sheet feeding apparatus, comprising:

a sheet stacking portion that stores sheets and sheet bundles;

a heated air blowing portion that blows heated air to the sheets stacked on the sheet stacking portion;

a control device that changes a control condition of the heated air blown by the heated air blowing portion;

a sheet bundle position detecting portion that detects a position of each sheet bundle which is added to a previously stacked sheet bundle on the sheet stacking portion; and a position storage portion that stores a position of each sheet bundle detected by the sheet bundle position detecting portion as position information, wherein the control device changes the control condition of the heated air blown by the heated air blowing portion based on a storage period of time in which each sheet bundle has been stored on the sheet stacking portion and the position information of each sheet bundle stored by the position storage portion.

2. The sheet feeding apparatus according to claim 1, wherein the control condition of the heated air is a temperature condition and the control device changes a temperature of the heated air.

3. The sheet feeding apparatus according to claim 1, wherein the control condition of the heated air is a temperature condition, the control device sets a temperature of the heated air blown by the heated air blowing portion to a first target temperature when the storage period of time of each sheet bundle is determined within a predetermined period of time based on a data of a time information and sets to a second target temperature lower than the first target temperature when the storage period of time of each sheet bundle is determined to pass the predetermined period of time based on the data of the time information, and the control device changes the temperature of the heated air based on the set temperature.

4. The sheet feeding apparatus according to claim 1, wherein the control device changes the control condition of the heated air based on at least one of an internal temperature of a sheet feeding apparatus body, an internal humidity thereof, and a type of each sheet stored therein, in addition to the storage period of time of each sheet bundle.

5. The sheet feeding apparatus according to claim 1, further comprising:

a lower sensor provided on a lower side of a sheet feeding apparatus body and an upper sensor provided on a upper side of the sheet feeding apparatus body, the control device determines a lift-up amount of the sheet stacking portion based on a detection by the lower sensor and the upper sensor while the sheet stacking portion is lifted up;

wherein the sheet stacking portion is capable of lifting and lowering, and wherein the control device determines the lift-up amount of the sheet stacking portion before the sheet bundle is added to the sheet stacking portion and the lift-up amount of the sheet stacking portion after the sheet bundle is added to the sheet stacking portion, and the control device calculates the position information of the added sheet bundle based on information of the lift-up amounts of the sheet stacking portion before and after adding the sheet bundle, which is stored by the position storage portion.

6. The sheet feeding apparatus according to claim 1, further comprising:

a supply time storage portion that stores a supply time of each sheet bundle as supply time information, for each sheet bundle that is supplied to an inner portion of a sheet feeding apparatus body, wherein the control device calculates a storage period of time of each sheet bundle from the supply time information that is stored by the supply time storage portion, and changes the control condition of the heated air blown by the heated air blowing portion based on the storage period of time of each sheet bundle.

7. The sheet feeding apparatus according to claim 1, wherein the heated air blowing portion includes a heater and a fan, and the control device changes a temperature of the heater to change a temperature of the heated air blown to the sheets.

8. An image forming apparatus comprising a sheet feeding apparatus to feed sheets and an image forming portion to form images on the sheets fed from the sheet feeding apparatus, wherein the sheet feeding apparatus includes:

a sheet stacking portion that stores the sheets and sheet bundles;

a heated air blowing portion that blows heated air to the sheets stacked on the sheet stacking portion;

a control device that changes a control condition of the heated air blown by the heated air blowing portion;

a sheet bundle position detecting portion that detects a position of each sheet bundle which is added to a previously stacked sheet bundle on the sheet stacking portion; and a position storage portion that stores a position of each sheet bundle detected by the sheet bundle position detecting portion as position information, wherein the control device changes the control condition of the heated air blown by the heated air blowing portion based on a storage period of time in which each sheet bundle has been stored on the sheet stacking portion and the position information of each sheet bundle stored by the position storage portion.

9. The image forming apparatus according to claim 8, wherein the control condition of the heated air is a temperature condition and the control device changes a temperature of the heated air.

10. The image forming apparatus according to claim 8, wherein the control condition of the heated air is a temperature condition, the control device sets a temperature of the heated air blown by the heated air blowing portion to a first target temperature when the storage period of time of each sheet is determined within a predetermined period of time based on a data of a time information and sets to a second target temperature lower than the first target temperature when the storage period of time of each sheet bundle is determined to pass the predetermined period of time based on the data of the time information, and the control device changes the temperature of the heated air based on the set temperature.

11. The image forming apparatus according to claim 8, wherein the control device changes the control condition of the heated air based on at least one of an internal temperature of a sheet feeding apparatus body, an internal humidity thereof, and a type of each sheet stored therein, in addition to the storage period of time of each sheet bundle.

12. The image forming apparatus according to claim 8, further comprising:

a lower sensor provided on a lower side of a sheet feeding apparatus body and an upper sensor provided on a upper side of the sheet feeding apparatus body, the control device determines a lift-up amount of the sheet stacking portion based on a detection by the lower sensor and the upper sensor while the sheet stacking portion is lifted up, wherein the sheet stacking portion is capable of lifting and lowering, and wherein the control device determines the lift-up amount of the sheet stacking portion before the sheet bundle is added to the sheet stacking portion and the lift-up amount of the sheet stacking portion after the sheet bundle is added to the sheet stacking portion, and the control device calculates the position information of the added sheet bundle based on information of the lift-up amounts of the sheet stacking portion before and after adding the sheet bundle, which is stored by the position storage portion.

13. The image forming apparatus according to claim 8, further comprising:

a supply time storage portion that stores a supply time of each sheet bundle as supply time information, for each sheet bundle that is supplied to an inner portion of a sheet feeding apparatus body, wherein the control device calculates a storage period of time of each sheet bundle from the supply time information that is stored by the supply time storage portion, and changes the control condition of the heated air blown by the heated air blowing portion based on the storage period of time of each sheet bundle.

14. The image forming apparatus according to claim 8, wherein the heated air blowing portion includes a heater and a fan, and the control device changes a temperature of the heater to change a temperature of the heated air blown to the sheets.

* * * * *